United States Patent [19]

Arnold et al.

[11] 4,077,901

[45] Mar. 7, 1978

[54] ENCAPSULATION OF NUCLEAR WASTES

[76] Inventors: John L. Arnold, 1305 Love; Raymond W. Boyle, 2900 Gibson, both of Midland, Mich. 48640

[21] Appl. No.: 619,329

[22] Filed: Oct. 3, 1975

[51] Int. Cl.[2] ..... G21F 9/16

[52] U.S. Cl. ..... 252/301.1 W; 260/37 EP; 260/40 R

[58] Field of Search ..... 252/301.1 W; 260/37 EP, 260/40 R

[56] References Cited

U.S. PATENT DOCUMENTS

| | | | |
|---|---|---|---|
| 3,367,992 | 2/1968 | Bearden | 260/23 AR |
| 3,463,738 | 8/1969 | Fitzgerald et al. | 252/301.1 W |
| 3,723,338 | 3/1973 | Godfrey | 252/301.1 W |
| 3,838,061 | 9/1974 | Cuaz et al. | 252/301.1 W |

OTHER PUBLICATIONS

Blanco et al., "Incorporating Industrial Wastes in Insoluble Media" Chemical Engineering Progress (vol. 66, No. 2) Feb. 1970, pp. 51-56.

*Primary Examiner*—Benjamin R. Padgett
*Assistant Examiner*—Deborah L. Kyle

[57] ABSTRACT

Toxic waste materials are encapsulated by the method wherein the waste material in liquid or finely divided solid form is uniformly dispersed in a vinyl ester resin or an unsaturated polyester and the resin cured under conditions that the exotherm does not rise above the temperature at which the integrity of the encapsulating material is destroyed.

19 Claims, No Drawings

ENCAPSULATION OF NUCLEAR WASTES

BACKGROUND OF THE INVENTION

Among the many problems associated with the utilization of nuclear fission is the disposal of radioactive waste materials. In the day-to-day operation of nuclear power plants there are aqueous evaporator wastes that are not only radioactive but range from highly acidic to highly alkaline and of diverse solute composition.

Also ion exchange resin beds are utilized to deionize the water used in the plant. Those beds require replacement from time to time. The heat exchanger bundles and other elements of the plant require descaling and other cleaning from time to time resulting in significant quantities of radioactive waste cleaning solutions.

One technique for disposal of such radioactive liquid wastes is to encapsulate the waste in a solid and to bury that solid in a designated place. In the past both concrete and urea-formaldehyde resins have been employed as the encapsulating material. Cement does not cure properly under acidic conditions, so that the acidity must be neutralized before encapsulation or a different material must be used. Also concrete is very heavy, handling is cumbersome and transport to the remote burial site is expensive.

Urea-formaldehyde resins have also been employed as the encapsulating material. However, because of a requirement of acidic cure and because of shrinkage during cure much of the aqueous material bleeds out of the solid. Also such resins result in undesirably high leaching rates in the fully cured state.

Nuclear plants also have problems with the disposal of radioactive finely divided solids. Those solids may be radioactive themselves or they may be absorbed on finely divided materials, such as filtering aids including, for example, various clays and charcoal.

Waste materials other than radioactive substances also present a waste disposal problem. For example, the heavy metal wastes from electroplating operations are very difficult to dispose of in an environmentally safe manner.

Another vexatious disposal problem involves the disposal of the toxic wastes from insecticide plants.

Many other disposal problems are a challenge to the ecological conscience.

THE PRIOR ART

Water-in-oil emulsions using an unsaturated polyester are shown in U.S. Pat. No. 3,442,842.

Water extended vinyl ester resins are taught in U.S. Pat. No. 3,792,006.

The encapsulation of radioactive liquid wastes and subsequent burial is well established in the art.

SUMMARY OF THE INVENTION

The present invention is directed to a method for encapsulating liquid or finely divided solid toxic waste substances into a form suitable for burial. In essence the method involves uniformly dispersing the waste in a liquid thermosettable polymer composition and thereafter curing the waste/polymer dispersion under thermal and catalytic conditions such that the exotherm developed during the cure never rises above the temperature at which the integrity of the encapsulating material is destroyed.

The method finds wide utility with diverse wastes. It is particularly useful with the radioactive wastes resulting from nuclear powered plants. Thus, it is adaptable for encapsulating wastes of high or low level radioactivity, of high or low acidity, of a wide variety of solutes and dispersed substances and of large or small amounts of waste. The method uses readily available materials that are easily handled in a safe manner.

The thermosettable polymer compositions include a vinyl ester resin or an unsaturated polyester or blends and mixtures of those two materials.

Vinyl ester resins are described in U.S. Pat. No. 3,367,992 wherein dicarboxylic acid half esters of hydroxyalkyl acrylates or methacrylates are reacted with polyepoxide resins. Bowen in U.S. Pat. Nos. 3,066,112 and 3,179,623 describes the preparation of vinyl ester resins from monocarboxylic acids such as acrylic and methacrylic acid. Bowen also describes alternate methods of preparation wherein a glycidyl methacrylate or acrylate is reacted with the sodium salt of a dihydric phenol such as bisphenol A. Vinyl ester resins based on epoxy novolac resins are described in U.S. Pat. No. 3,301,743 to Fekete et al. Fekete et al. also describe in U.S. Pat. No. 3,256,226 vinyl ester resins wherein the molecular weight of the polyepoxide is increased by reacting a dicarboxylic acid with the polyepoxide resin as well as acrylic acid, etc. Other difunctional compounds containing a group which is reactive with an epoxide group, such as an amine, mercaptan, and the like, may be utilized in place of the dicarboxylic acid. All of the above-described resins, which contain the characteristic linkages.

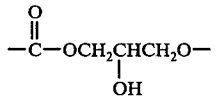

and terminal, polymerizable vinylidene groups, are classified as vinyl ester resins, and are incorporated herein by reference.

Briefly, any of the known polyepoxides may be employed in the preparation of the vinyl ester resins of this invention. Useful polyepoxides are glycidyl polyethers of both polyhydric alcohols and polyhydric phenols, epoxy novolacs, epoxidized fatty acids or drying oil acids, epoxidized diolefins, epoxidized di-unsaturated acid esters as well as epoxidized unsaturated polyesters, so long as they contain more than one oxirane group per molecule. The polyepoxides may be monomeric or polymeric.

Preferred polyepoxides are glycidyl polyethers of polyhydric alcohols or polyhydric phenols having weights per epoxide group of about 150 to 2000. These polyepoxides are usually made by reacting at least about two moles of an epihalohydrin or glycerol dihalohydrin with one mole of the polyhydric alcohol or polyhydric phenol, and a sufficient amount of a caustic alkali to combine with the halogen of the halohydrin. The products are characterized by the presence of more than one epoxide group per molecule, i.e., a 1,2-epoxy equivalency greater than one.

Unsaturated monocarboxylic acids include acrylic acid, methacrylic acid, halogenated acrylic or methacrylic acid, cinnamic acid and the like and mixtures thereof, and hydroxyalkyl acrylate or methacrylate half esters of dicarboxyl acids as described in U.S. Pat. No. 3,367,992 wherein the hydroxyalkyl group preferably has from 2 to 6 carbon atoms.

Preferably the thermosettable resin phase comprises from 40 to 70 weight percent of the vinyl ester or polyester resin and from 60 to 30 percent of a copolymerizable monomer. Suitable monomers must be essentially water insoluble to maintain the monomer in the resin phase in the emulsion, although complete water insolubility is not required and a small amount of monomer dissolved in the emulsified water does no harm.

Suitable monomers include vinyl aromatic compounds such as styrene, vinyl toluene, divinyl benzene and the like saturated alcohols such as methyl, ethyl, isopropyl, octyl, etc., esters of acrylic acid or methacrylic acid; vinyl acetate, diallyl maleate, dimethallyl fumarate; mixtures of the same and all other monomers which are capable of copolymerizing with the vinyl ester resin and are essentially water insoluble.

Another embodiment of this invention utilizes a modified vinyl ester resin wherein about 0.1 to 0.6 moles of a dicarboxylic acid anhydride per equivalent of hydroxyl is reacted with the vinyl ester resin. The stability of the water-in-resin emulsion prepared from said modified vinyl ester resin is somewhat less, comparatively, than that found with the unmodified vinyl ester resins, yet the stability is significantly improved over the art. Both saturated and unsaturated acid anhydrides are useful in said modification.

Suitable dicarboxylic acid anhydrides containing ethylenic unsaturation include maleic anhydride, the citraconic anhydride, itaconic anhydride and the like and mixtures thereof. Saturated dicarboxylic acid anhydrides include phthalic anhydride, anhydrides of aliphatic unsaturated dicarboxylic acid and the like. The modified vinyl ester resin is utilized in this invention in the same manner as already described for the unmodified vinyl ester resin.

A wide variety of unsaturated polyesters which are readily available or can be prepared by methods well known to the art may also be utilized in the method. Such polyesters result from the condensation of polybasic carboxylic acids and compounds having several hydroxyl groups. Generally, in the preparation of suitable polyesters, an ethylenically unsaturated dicarboxylic acid such as maleic acid, fumaric acid, itaconic acid or the like is interesterified with an alkylene glycol or polyalkylene glycol having a molecular weight of up to 2000 or thereabouts. Frequently, dicarboxylic acids free of ethylenic unsaturation such as phthalic acid, isophthalic acid, adipic acid, succinic acid and the like may be employed within a molar range of 0.25 to as much as 15 moles per mole of the unsaturated dicarboxylic acid. It will be understood that the appropriate acid anhydrides when they exist may be used and usually are preferred when available.

The glycol or polyhydric alcohol component of the polyester is usually stoichiometric or in slight excess with respect to the sum of the acids. The excess of polyhydric alcohol seldom will exceed 20–25 percent and usually is about 10 to 15 percent.

These unsaturated polyesters may be generally prepared by heating a mixture of the polyhydric alcohol with the dicarboxylic acid or anhydride in the proper molar proportions at elevated temperatures, usually at about 150° to 225° C for a period of time ranging from about 1 to 5 hours.

Polymerization inhibitors such as t-butyl catechol may be advantageously added. It is also possible to prepare unsaturated polyesters directly from the appropriate oxide rather than the glycol, e.g., propylene oxide may be used in place of propylene glycol. Generally, the condensation (polymerization) reaction is continued until the acid content drops to about 2 to 12 percent (—COOH) and preferably from 4 to 8 percent.

Yet, another embodiment of this invention utilizes a vinyl ester/unsaturated polyester resin composition wherein the weight ratio of said polyester to said vinyl ester ranges up to 2:3. The composition may be prepared either by physically mixing the two resins in the desired weight proportions or by preparing said vinyl ester resin in the presence of said unsaturated polyester. These vinyl ester/unsaturated polyester resin compositions readily form waste-in-resin dispersions in the same manner as previously described for the vinyl ester resins even though the unsaturated polyesters, alone, at times do not form stable emulsions with liquid waste materials.

In the practice of the method of this invention, waste material-in-resin dispersions, may be prepared in a variety of ways. Generally a free radical yielding catalyst is blended with the phase and the waste then dispersed in that resin under conditions to form a uniform dispersion. When the waste is a solid, it should be finely divided of a size generally less than about ⅛ inch or less. When the waste is a liquid, it is preferred to form a liquid waste-in-resin emulsion. In that instance the liquid is added to the liquid uncured resin under shearing conditions to form the emulsion. While the shear conditions may be widely varied, generally with liquid wastes sufficient shear should be applied to produce a relatively uniform emulsion of small droplet size.

The dispersions, whether of liquid or solid disperse phase, should have sufficient storage stability to last at least through the initial gelation of the resin. The dispersions made with vinyl ester resins, particularly those within the previously described monomer proportions, generally exhibit adequate stability without added emulsifier. Emulsions made with unsaturated polyesters frequently will require added emulsifier. Such emulsifiers are known in the art and judicious selection can be made with simple routine experiments.

The proportions of liquid waste in the resin phase are also important by reason that these emulsified liquids serve as a heat sink and assist in control of exotherm and final temperature. Preferably the compositions (waste-in-resin emulsions) are prepared to contain from about 30 to 75 percent by weight of liquid waste with the balance comprising the resin phase.

Catalysts that may be used for the curing or polymerization are preferably the peroxide and hydroperoxide catalysts such as benzoyl peroxide, lauroyl peroxide, t-butyl hydroperoxide, methyl ethyl ketone peroxide, t-butyl perbenzoate, potassium persulfate and the like. The amount of the catalyst added will vary preferably from 0.1 to about 5 percent by weight of the resin phase.

Preferably, the cure of the emulsion can be initiated at room temperature by the addition of known accelerating agents or promoters, such as lead or cobalt naphthenate, dimethyl aniline, N,N-dimethyl-P-toluidine and the like usually in concentration ranging from 0.1 to 5.0 weight percent. The promoted emulsion can be readily cured in about 3 to 30 minutes, depending on the temperature, the catalyst level and the promotor level. Cure of the emulsion can also be initiated by heating to temperature of below 100° C. The common practice of post curing thermost articles at elevated temperatures for varying periods of time may be utilized with this invention.

The conditions of selection of catalyst, catalyst concentration and promoter selection and concentration must be such that the temperature of the exotherm does not exceed 100° C. If the exotherm exceeds 100° C, the water in the liquid waste will boil which may cause waste material to be released.

The solidification may be carried out in any suitable vessel such as a 55 gallon drum. Larger or smaller vessels may be used depending on the amount of waste to be disposed of, on the equipment available and on the limitations of handling and transportation stock.

The method of the invention is illustrated in the following examples wherein all parts and percentages are by weight unless otherwise indicated.

EXAMPLE 1

A simulated radioactive evaporator waste was prepared in water and 2.0 microcuries cobalt 60 and 0.92 microcurie Cesium 137 were added as the chloride salts.

422.5 grams of the waste was solidified with the following ingredients: 338 grams of a vinyl ester resin made by reacting 32.6 parts of the diglycidyl ether of bisphenol A extended with 8.7 parts of bisphenol A then reacted with 1.2 parts maleic anhydride and 7.5 parts methacrylic acid, the resin dissolved in 50 parts styrene; 8.45 grams of 40 percent benzoyl peroxide emulsified in dibutyl phthalate; 1.125 grams of N,N-dimethyl-p-toluidine.

The vinyl ester resin and benzoyl peroxide solution were measured into a large metal vessel and mixed thoroughly with an air stirrer. The radioactive waste was slowly added to the above blend with the air stirrer at high speed to assure good emulsification. The dimethyl toluidine was added to the emulsion and mixed thoroughly for 30 to 60 seconds. The stirrer was removed and the emulsion poured into plastic containers of 4.75 centimeters diameter and 7.3 centimeters length. The emulsion cured to a hard homogeneous solid.

Specimens of the cured solids were tested accordingly to the special tests for massive solids as listed in Section 173.398, Hazardous Materials Regulations of the Department of Transportation.

In the water leaching test the specimen is immersed for 1 week in water at pH 6–8 and 68° F and a maximum conductivity of 10 micromhos/centimeter, and by immersion in air at 86° F. To pass this test the product must not dissolve or convert into dispersible form to the extent of more than 0.005 percent by weight.

When so tested the specimen of this example did not dissolve or convert into dispersible form and in fact showed 0 percent weight loss.

When tested according to the International Atomic Energy Agency Safety Standards, Safety Series Number 6, Regulations for the Safe Transport of Radioactive Materials, 1973 Revised Edition the leaching water showed 0.085 microcurie of $Co^{60}$ and 0.042 microcurie $Cs^{137}$. This is less than 10 percent of the radioactive material present in the original sample.

EXAMPLE 2

Specimens of the solids were prepared as in Example 1 and were exposed to $20 \times 10^6$ Rads gamma radiation (equivalent to a lifetime exposure to 10 Curries $Co^{60}$ in 55 gallons total volume). When tested by the procedures of the previous example the specimen showed a weight gain of 1.8 percent by the Department of Transportation test. The leach water from the IAEA test measured 0.080 microcurie $CO^{60}$ and 0.045 microcurie $Cs^{137}$. This is less than 10 percent of the radioactive material present in the original sample.

EXAMPLE 3

Specimens of the solids of Example 1 were exposed to a percussion test contained in the identified Department of Transportation Regulations. In that test the flat circular end of a one inch diameter steel rod weighing three pounds is dropped onto the specimen from a distance of forty inches. The specimen is placed on a sheet of lead, hardness number 3.5 to 4.5 on the Vickers scale, and not more than one inch thick supported by a smooth, essentially unyielding surface. To pass this test the product must not break, crumble or shatter.

When subjected to this test the steel rod rebounded with no damage to the specimens.

EXAMPLE 4

Solid specimens of Example 1 were tested for compressive strength. When so tested, the solids showed a compressive strength of 2470 pounds per square inch. After exposure to $20 \times 10^6$ Rads gamma radiation and tested the specimen showed a compressive strength of 2550 pounds per square inch. This indicates no polymer degradation due to the radiation exposure.

EXAMPLE 5

Specimens of the solids of Example 1 were subjected to a heat exposure test outlined in the Department of Transportation Regulations identified in that example. In that test, the specimen is exposed in air to a temperature of 1000° F for 10 minutes. To pass this test, the specimen must not melt, sublime or ignite.

The solids of this invention passed this test. The tested specimen was subjected to the aforementioned leaching test and after 7 days retained 94.5 percent of the waste material.

Beyond the requirements of the test, it was noticed that the outside surface of the specimen darkened with small circular surface cracks and a weight loss of 14.5 percent. The specimen showed a compressive strength of 1800 PSI.

A similar specimen prepared from urea-formaldehyde resin darkened, distorted and showed a weight loss of 33.3 percent and had a compressive strength of 300 PSI.

A comparable specimen prepared from cement developed small surface cracks showed a weight loss of 11.1 percent and had a compressive strength of 1700 PSI.

EXAMPLE 6

A simulated waste cleaning solution of organic chelating agents in water was prepared.

1950 grams of the waste solution was solidified in 1560 grams of the vinyl ester resin of Example 1; 0.87 gram of N,N-dimethyl-p-toluidine; 29.25 grams of the 40 percent dibutyl phthalate emulsion of benzoyl peroxide.

The vinyl ester resin and dimethyl toluidine were measured into a one gallon metal vessel and mixed thoroughly with an air stirrer. The waste solution at 40° C was slowly added to that blend with the air stirrer at high speed. The benzoyl peroxide was then added and mixed thoroughly for three minutes. The stirrer was removed and a thermocouple inserted. The emulsion gelled in 8 minutes reaching a peak temperature of 92.5° C. The cured emulsion was a hard uniform solid.

EXAMPLE 7

An ion exchange resin slurry was prepared by saturating beads of the resin with water and then adding more water to make a flowable slurry.

1872 grams of the slurry were solidified in 1560 grams of the vinyl ester resin of Example 1; 1.56 grams N,N-dimethyl-p-toluidine; 39 grams of the 40 percent dibutyl phthalate emulsion of benzoyl peroxide.

The vinyl ester resin and dimethyl toluidine were mixed thoroughly in a one gallon metal vessel with an air stirrer. The aqueous slurry was slowly added with the air stirrer at high speed. The benzoyl peroxide was added and mixed thoroughly. The stirrer was removed and a thermocouple inserted. The emulsion gelled in 9 minutes, reached a peak temperature of 91° C and cured to a hard uniform solid.

Comparable benefits and results have been obtained when similar compositions utilizing an unsaturated polyester sold commercially as a hand layup resin as Unican FR-1 by the Unican Corporation in place of the vinyl ester resin.

The vinyl ester resin formulations have been used successfully in encapsulating simulated waste materials in 55 gallon drums. The liquid wastes include a chemical decontamination solvent from a commercial nuclear power plant, a chemical cleaning solvent from a different nuclear power plant, an evaporator concentrate with high boric acid concentration at pH 2.8, an evaporator concentrate at pH 10.6, and a demineralizer resin. In all instances, the exotherm was controlled below 100° C.

What is claimed is:

1. A method for encapsulating liquid waste materials comprising uniformly dispersing said waste material into a fluid thermosettable resin composition of (1) a vinyl ester resin prepared by reacting about equivalent proportions of an unsaturated monocarboxylic acid and a polyepoxide resin, said vinyl ester resin containing $$-\overset{\overset{\displaystyle O}{\|}}{C}-OCH_2\underset{\underset{\displaystyle OH}{|}}{C}HCH_2O-$$

linkage groups and terminal vinylidene groups attached to the ester end of said linkage or (2) an unsaturated polyester or (3) mixture thereof and a catalyst for curing said resin, and curing said composition under conditions that the exotherm is maintained below 100° C.

2. The method of claim 1 wherein said liquid waste material is present in an amount of from about 30 to 75 weight percent in a liquid-in-resin emulsion said emulsion containing correspondingly from about 70 to 25 weight percent of the vinyl ester resin phase; said resin phase comprising from about 40 to 70 weight percent of a vinyl ester resin and from about 60 to 30 weight percent of a water insoluble vinyl monomer copolymerizable therewith.

3. The resin composition of claim 2 wherein said polyepoxide resin is a glycidyl polyether of a polyhydric phenol or polyhydric alcohol.

4. The resin composition of claim 2 wherein said acid is acrylic acid, methacrylic acid or a dicarboxylic acid half ester of a hydroxyalkyl acrylate or methacrylate, said hydroxyalkyl group containing from 2 to 6 carbon atoms.

5. The resin composition of claim 2 wherein said vinyl ester resin has been further reacted with from about 0.1 to 0.6 mole of a dicarboxylic acid anhydride per equivalent of hydroxyl group in said vinyl ester resin.

6. The resin composition of claim 2 wherein said vinyl monomer is a vinyl aromatic monomer or a saturated alcohol ester of acrylic or methacrylic acid.

7. The resin composition of claim 6 wherein said vinyl monomer is styrene.

8. The method of claim 1 wherein said unsaturated polyester is the water insoluble reaction product of at least one polyol and at least one polycarboxylic acid of which at least a substantial portion is an alpha,beta-ethylenically unsaturated polycarboxylic acid.

9. The method of claim 8 wherein said polyol is a diol and said alpha, beta-ethylenically unsaturated polycarboxylic acid is a dicarboxylic acid.

10. The method of claim 9 wherein said diol is butane diol-1,4 and said acid is maleic acid.

11. The method of claim 8 wherein said polyester is dissolved in a vinyl monomer.

12. The method of claim 11 wherein said vinyl monomer is styrene.

13. The method of claim 1 wherein said catalyst is a peroxide or hydroperoxide.

14. The method of claim 13 wherein said peroxide is benzoyl peroxide emulsified in dibutyl phthalate.

15. The method of claim 13 wherein said catalyst is used together with a promoter.

16. The method of claim 15 wherein said promoter is N,N-dimethyl-p-toluidine.

17. The method of claim 1 wherein said liquid waste material is a waste cleaning solution of an organic chelant in water.

18. The method of claim 1 wherein said liquid waste material is an evaporator waste from a nuclear power plant.

19. The method of claim 1 wherein said liquid waste material is a fluid aqueous slurry of an ion exchange resin.

* * * * *